US010723168B1

(12) United States Patent
Mitchell et al.

(10) Patent No.: US 10,723,168 B1
(45) Date of Patent: Jul. 28, 2020

(54) STAIR LAYOUT TEMPLATE AND METHOD FOR USING THE TEMPLATE

(71) Applicants: Steven A. Mitchell, Westminster, CO (US); Paul E. Sanders, Arvada, CO (US); Jonathan D. Mitchell, Westminster, CO (US)

(72) Inventors: Steven A. Mitchell, Westminster, CO (US); Paul E. Sanders, Arvada, CO (US); Jonathan D. Mitchell, Westminster, CO (US)

( * ) Notice: Subject to any disclaimer, the term of this patent is extended or adjusted under 35 U.S.C. 154(b) by 187 days.

(21) Appl. No.: 15/880,430

(22) Filed: Jan. 25, 2018

Related U.S. Application Data

(60) Provisional application No. 62/450,358, filed on Jan. 25, 2017.

(51) Int. Cl.
*E04F 21/26* (2006.01)
*B43L 13/20* (2006.01)
*B43L 13/00* (2006.01)

(52) U.S. Cl.
CPC ..... *B43L 13/20* (2013.01); *E04F 21/26* (2013.01); *B43L 13/007* (2013.01)

(58) Field of Classification Search
CPC ..... E04F 21/26
USPC ..... 33/566, 429
See application file for complete search history.

(56) References Cited

U.S. PATENT DOCUMENTS 1,527,647 A * 2/1925 Heinen ..... B25H 7/04 33/420
1,588,962 A * 6/1926 Harrison ..... B25H 7/04 33/476
1,834,389 A * 12/1931 Drescher ..... E04F 21/26 33/418
2,494,462 A * 1/1950 Van Winkle ..... E04F 21/26 33/418
3,112,568 A * 12/1963 Baker ..... E04F 21/26 33/421
3,153,859 A * 10/1964 Jones ..... E04G 21/1891 33/419
3,478,434 A * 11/1969 Catalano ..... E04F 21/26 33/418
3,623,232 A * 11/1971 Mahlstadt ..... B25H 7/02 33/427
4,280,282 A * 7/1981 Wright ..... B43L 13/206 33/427
4,833,791 A * 5/1989 Campbell ..... B43L 13/206 33/464

(Continued)

*Primary Examiner* — Christopher W Fulton
(74) *Attorney, Agent, or Firm* — Shifrin Patent Law; Dan Shifrin

(57) ABSTRACT

Embodiments of the present invention provide a stair layout template that reduces the opportunity for errors when constructing a set of stairs. Embodiments also provide a method for using the template to construct a set of stairs. The template indicates to the builder where a particular set of marks are to be made on the insides (the sides where the tread modules are attached) of both stringers. These marks include the cut marks for the bottom and top ends of the stringers and the "screw set points" that indicate where the tread modules will be attached to the stringers. The template is reversible, with the mirrored markings on both sides, so that the process for one stringer is the mirror image of the other stringer.

8 Claims, 11 Drawing Sheets

(56) References Cited

U.S. PATENT DOCUMENTS

| | | | | | |
|---|---|---|---|---|---|
| 4,882,846 | A * | 11/1989 | Reed | E04F 21/26 | 33/464 |
| 5,388,340 | A * | 2/1995 | Marty | E04F 21/26 | 33/421 |
| 5,461,798 | A * | 10/1995 | Ribeiro | E04F 21/26 | 33/415 |
| D366,844 | S * | 2/1996 | Schroeder | D10/64 | |
| 6,233,835 | B1 * | 5/2001 | Brown | B25H 7/00 | 33/27.02 |
| D503,634 | S * | 4/2005 | Emerson | D10/64 | |
| 6,918,189 | B1 * | 7/2005 | McBrayer | B25H 7/00 | 33/1 G |
| 7,627,955 | B1 * | 12/2009 | Perkey | B43L 7/14 | 33/427 |
| 7,743,521 | B2 * | 6/2010 | O'Morrow, Sr. | B43L 7/005 | 33/417 |
| 2011/0107610 | A1 * | 5/2011 | Farr | B43L 7/12 | 33/421 |
| 2012/0285028 | A1 * | 11/2012 | Atwood | B43L 7/10 | 33/452 |

* cited by examiner

STAIR LAYOUT TEMPLATE AND METHOD FOR USING THE TEMPLATE

RELATED APPLICATION DATA

The present application claims the benefit of commonly-owned U.S. Provisional Patent Application Ser. No. 62/450,358 entitled STAIR LAYOUT TEMPLATE AND METHOD FOR USING THE TEMPLATE, filed on Jan. 25, 2017, which application is incorporated herein by reference in its entirety.

TECHNICAL FIELD

The present invention relates generally to the construction of stairs and, in particular, to a template for laying out cutting marks and screw set points of a new set of stairs and to a method using the template.

BACKGROUND ART

Constructing a set of stairs, such as exterior residential stairs, from two full, unnotched stringers with clear-spanning tread modules attached between them can be tedious and time-consuming requiring exacting and consistent measurements for each cut. Mistakes in measuring or cutting often necessitate starting over with a fresh stringer, adding to the time and expense of construction.

SUMMARY OF THE INVENTION

Embodiments of the present invention provide a stair layout template that reduces the opportunity for errors when constructing a set of stairs. Embodiments also provide a method for using the template to construct a set of stairs. The template indicates to the builder where a particular set of marks are to be made on the insides (the sides where the tread modules are attached) of both stringers. These marks include the cut marks for the bottom and top ends of the stringers and the "screw set points" that indicate where the tread modules will be attached to the stringers. The template is reversible, with the mirrored markings on both sides, so that the process for one stringer is the mirror image of the other stringer.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
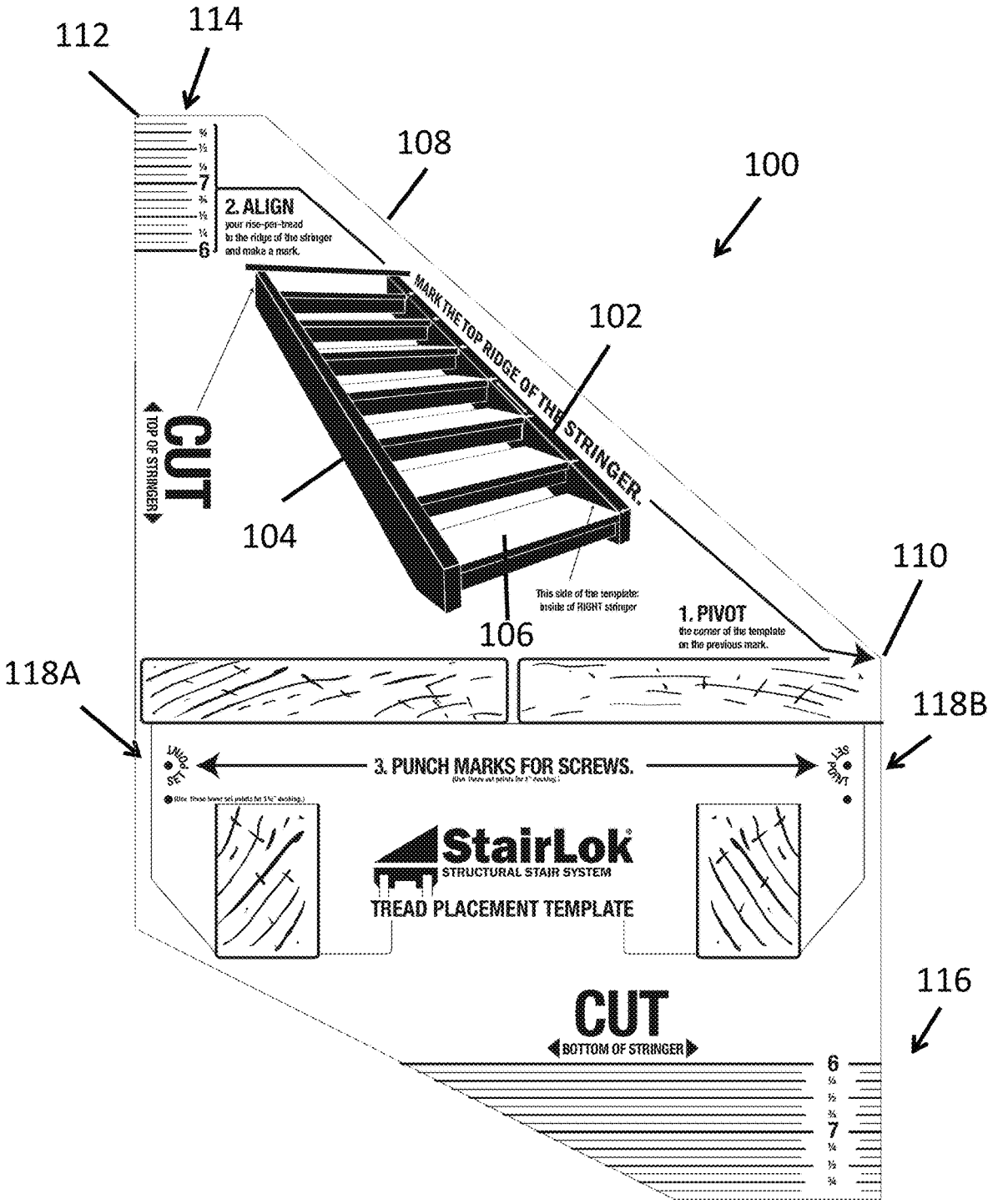
FIG. 1 illustrates one side of an embodiment of the stair layout template of the present invention.
Figure 2:
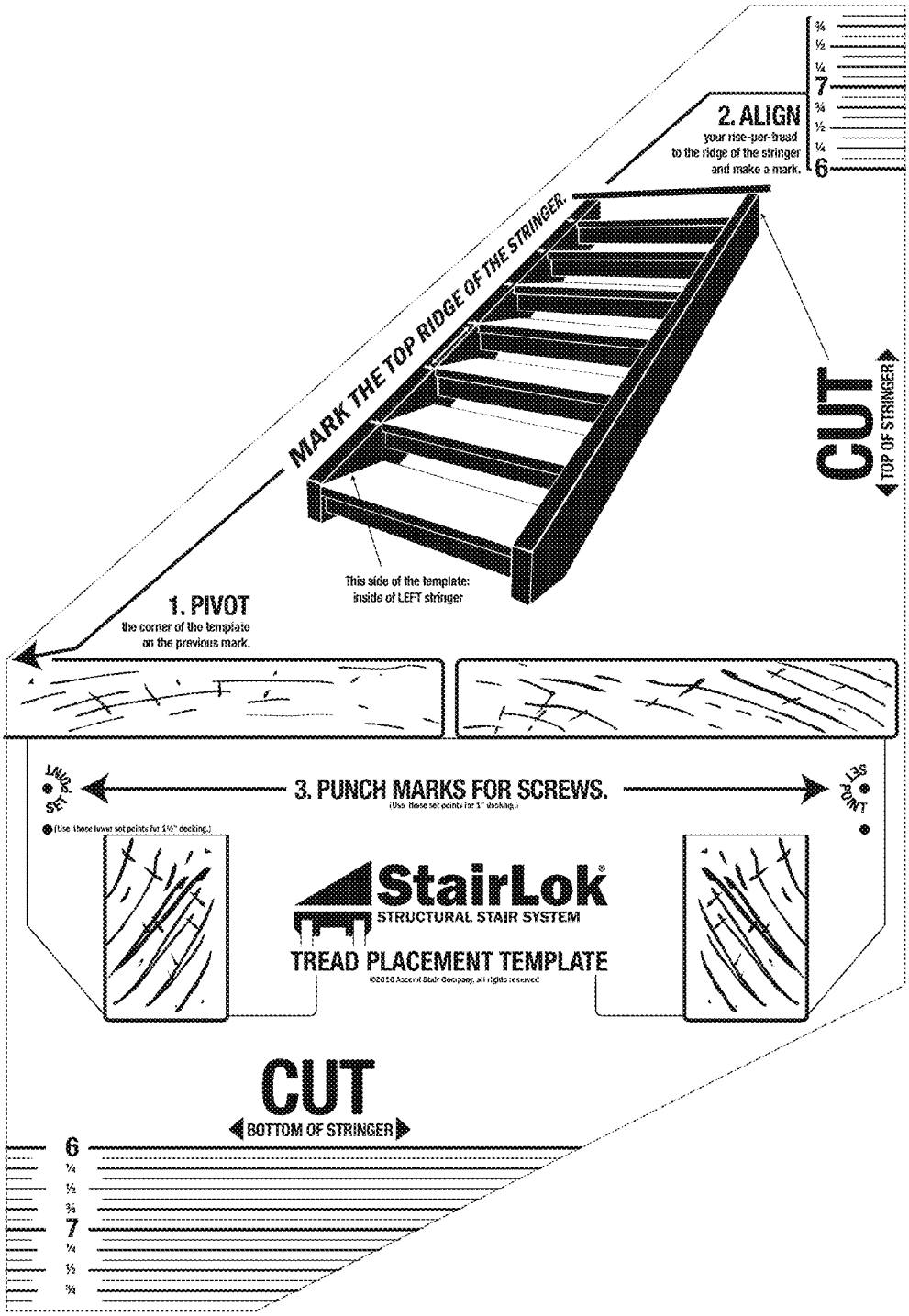
FIG. 2 illustrates the opposite side of the template of FIG. 1.

FIGS. 1 and 2 illustrate the two sides of an embodiment of the stair layout template 100 of the present invention. The first side (FIG. 1) is used to lay out the cutting lines and tread screw set points of the right stringer 102 of a set of stairs to be constructed and the opposite side (FIG. 2), being the mirror of the first side, is used to lay out the cutting lines and tread screw set points of the left stringer 104. As illustrated in FIGS. 1 and 2, the tread screw set points on one side of the template 100 are aligned through the template 100 with the tread screw set points on the other side. After the tops and bottoms of the stringers 102, 104 have been cut and the screw holes marked, the tread modules 106 are secured between the stringers 102, 104 using screws at the marked set points through two corresponding screw holes of each side of the tread module 106.

The template 100 is to be applied to stair building where the builder is using two full 2×10, 2×12, or other size stringers 102, 104 (un-notched like conventional residential exterior stair stringers) with clear-spanning tread modules 106 attached in between them. The template 100 is used to lay out a particular set of marks on the insides (the sides where the tread modules 106 are attached) of both stringers 102, 104. The process for one stringer is simply a mirror image of the other stringer. The template 100 is reversible, with the mirrored markings on both sides. Each side of the template 100 indicates the stringer, right or left, for which the side is to be used.

The template 100 may initially be provided on a large card and the builder may then cut the card along the outline 108 to create the template. Alternatively, the template 100 may be provided to builders in pre-cut form. The precut form of the template 100 could be produced in either a non-durable material like paperboard or a more durable material like plastic or metal.

Figure 3:
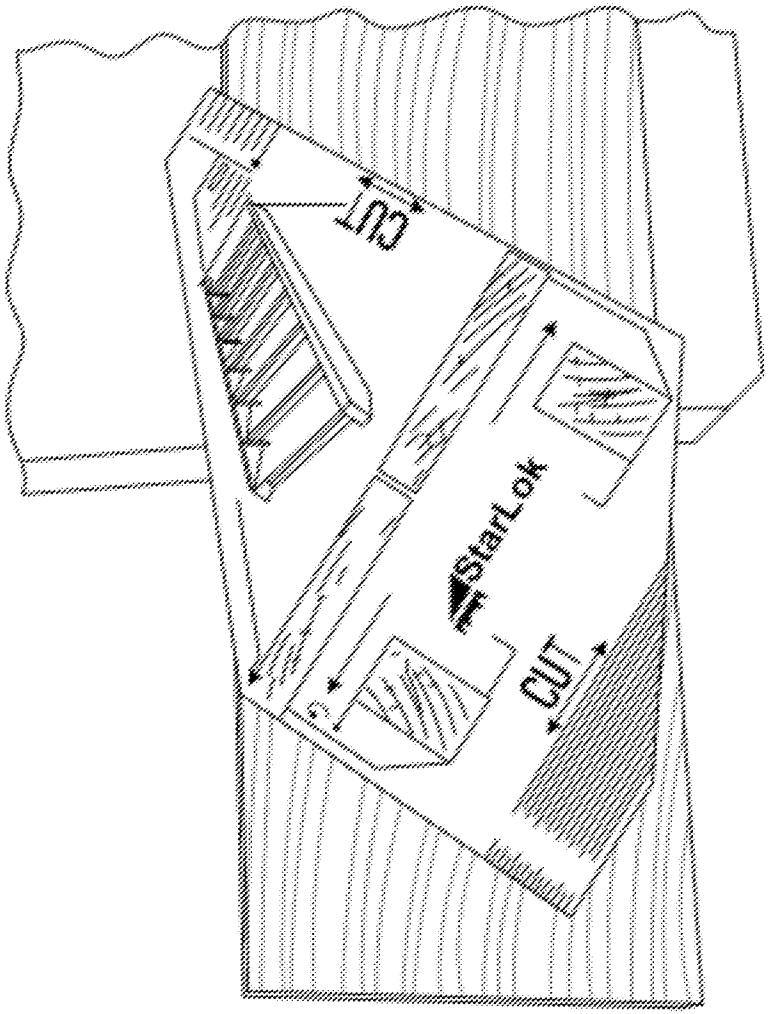
FIGS. 3-9 illustrate a method of using the template of FIG. 1 to mark cutting lines for the bottom of the stringers of a new set of stairs.
Figure 4:
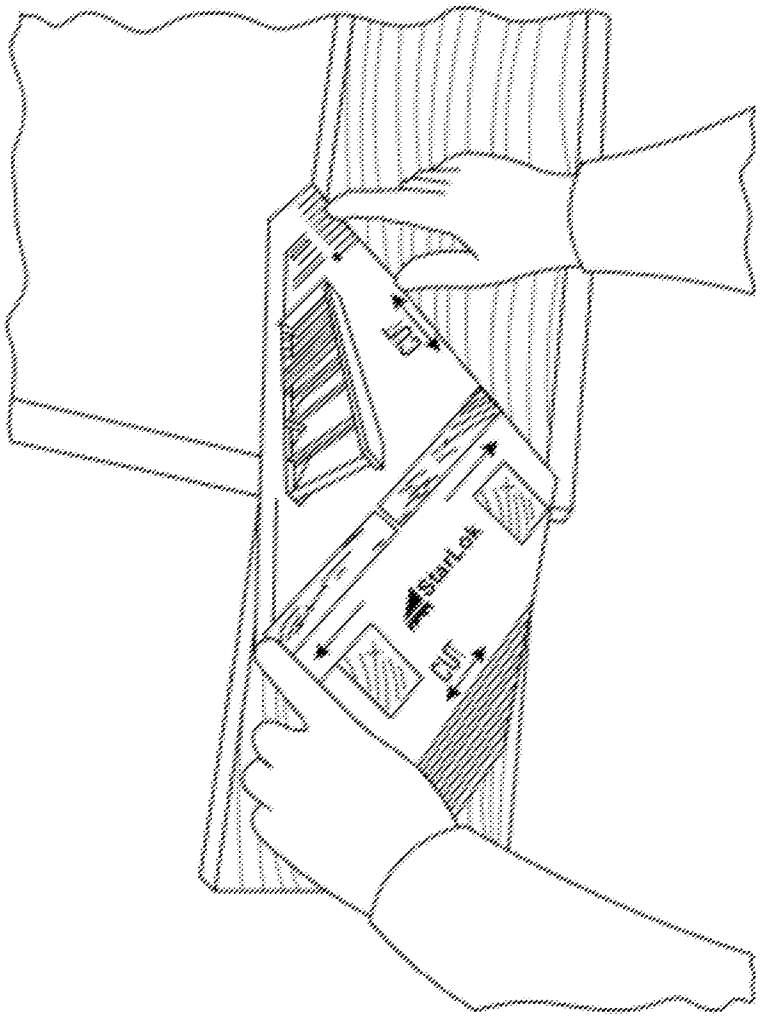

FIGS. 3-9 illustrate a method of using the template 100 to mark cutting lines for the bottom of the stringers of a new set of stairs. For purposes of this description, the right stringer 102 will be used; it will be appreciated that the method is the same for the left stringer 104. The builder begins at what will be the bottom (lower) end of the stringer 102, marking on the side of the stringer 102 that will face the inside of the stair. A pivot point 110, indicated on one corner of the template 100 as "1. PIVOT" is first aligned corner with the top (crowned) edge of the stringer 102, about five or more inches from the end of the stringer 102 because the end of the stringer 102 that will be on the ground extends beyond the first pivot point 110 (FIG. 3).

Figure 5:
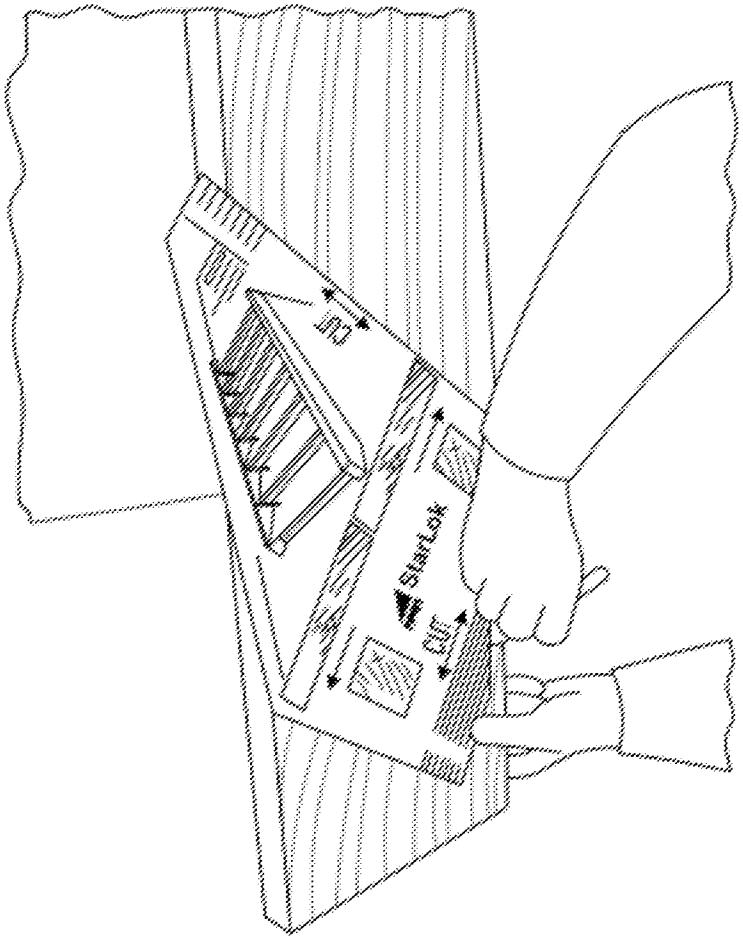
Figure 6:
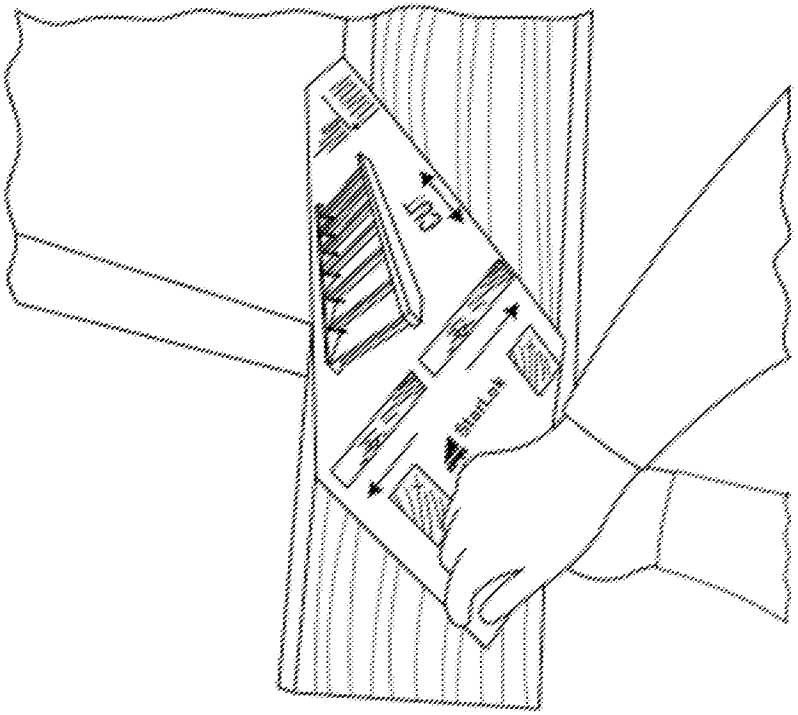
Figure 7:
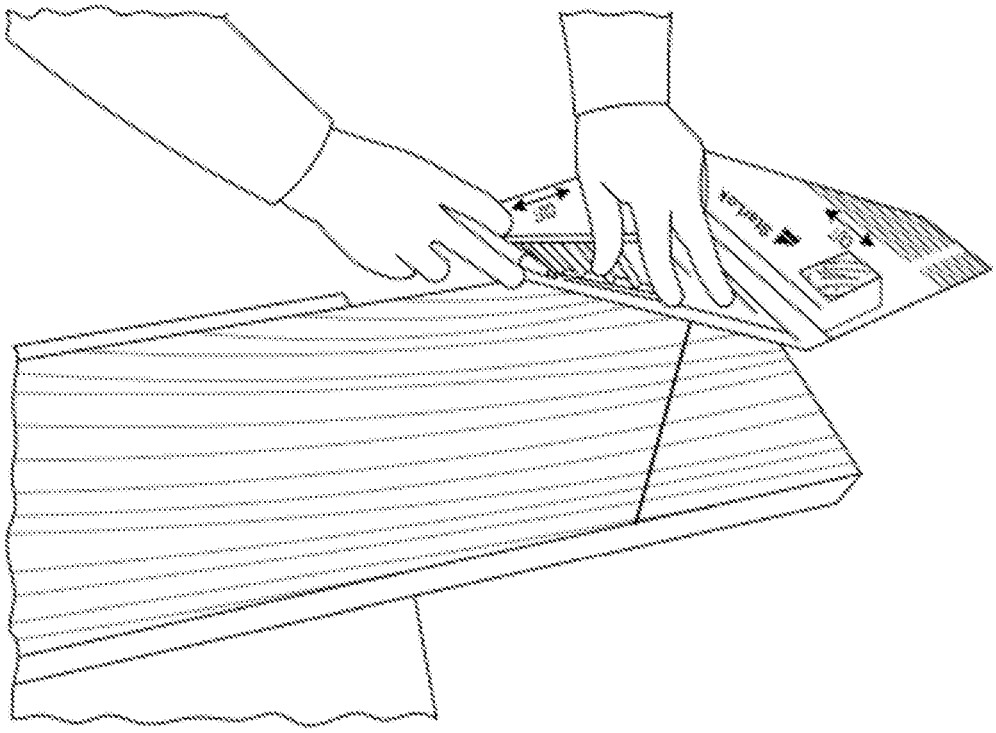
Figure 8:
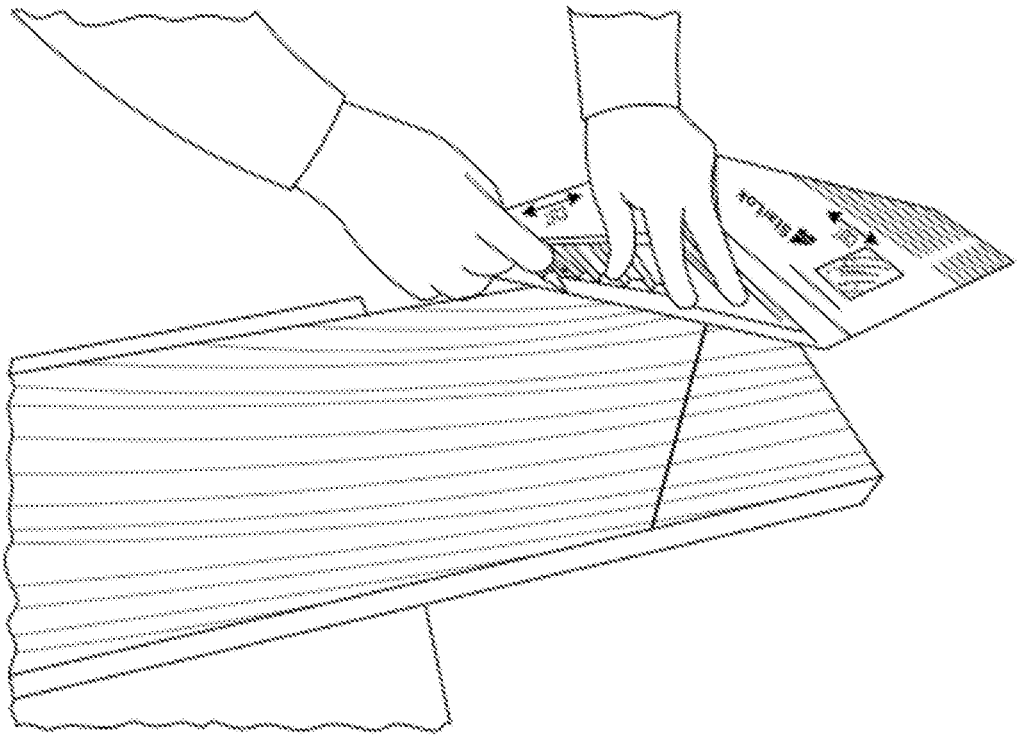
Figure 9:
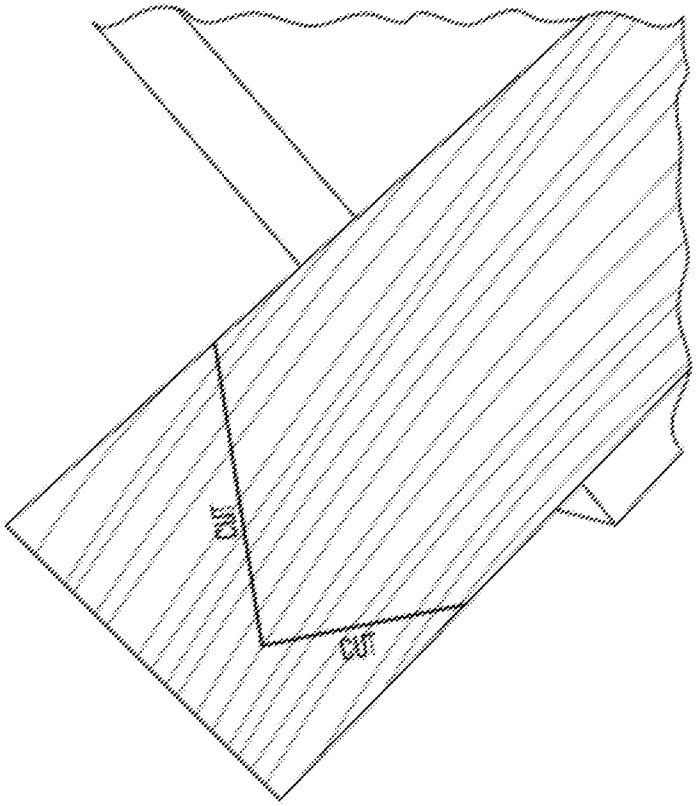

While holding the pivot point 110 at the edge of the stringer 102 (FIG. 4), a second corner 112, indicated as "2. ALIGN" on the template 100, is aligned with the edge of the stringer 102 where the index line on a scale 114 on one edge of the template 100 corresponds to the rise-per-tread of the stair. This mark will be an index mark for the next step (and one of a set of marks in the series of tread locations). The edge of the stringer 102 is then marked at point of a second scale 116 on the template 100 that corresponds to the rise of the stair (FIG. 5). Before moving the template, a line is drawn along the edge adjacent to the first corner 110, where front of the bottom of the stringer 102 will later be (FIG. 6). This line will be the first of the two cut lines for the bottom of the stringer 102. Both sides of the template 100 are marked with a second scale 116, on another edge of the template 100, at the bottom inch marks that correspond to the stair's rise per tread. These two points when connected by a line (FIGS. 7, 8) will indicate the second cut line for the base of the bottom of the stringer 102 (FIG. 9).

Figure 10:
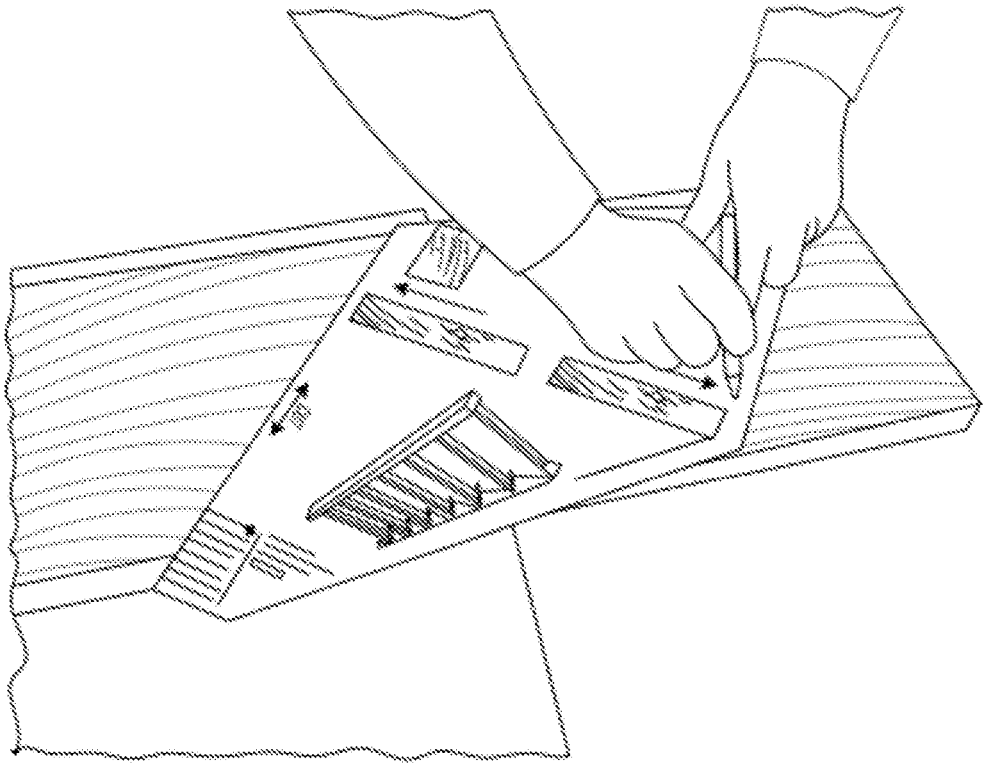
FIGS. 10-15 illustrate a method of using the template of FIG. 1 to mark the locations of tread screw set points of a new set of stairs.
Figure 11:
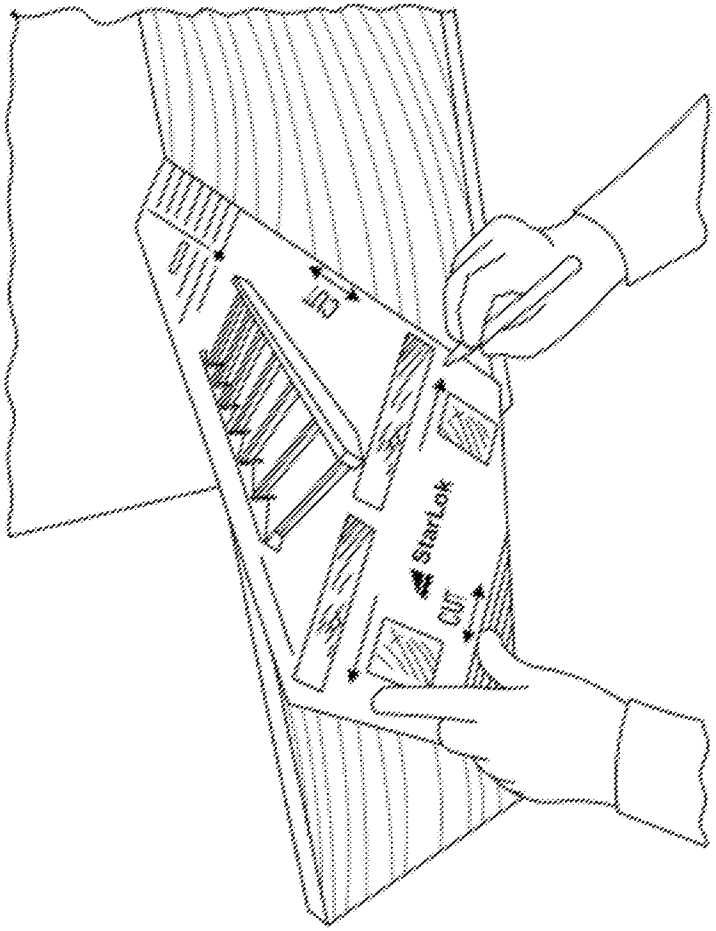

The first two screw set points 118A, 118B (FIGS. 10, 11) are marked or punched through the holes in the template 100. The marked set points will later serve to locate the tread modules 106 on the stringer by showing where the screws come through the screw holes in the tread module 106 and into the stringers 102, 104. Different pairs of screw set points are provided to accommodate tread materials of different thicknesses.

Figure 12:
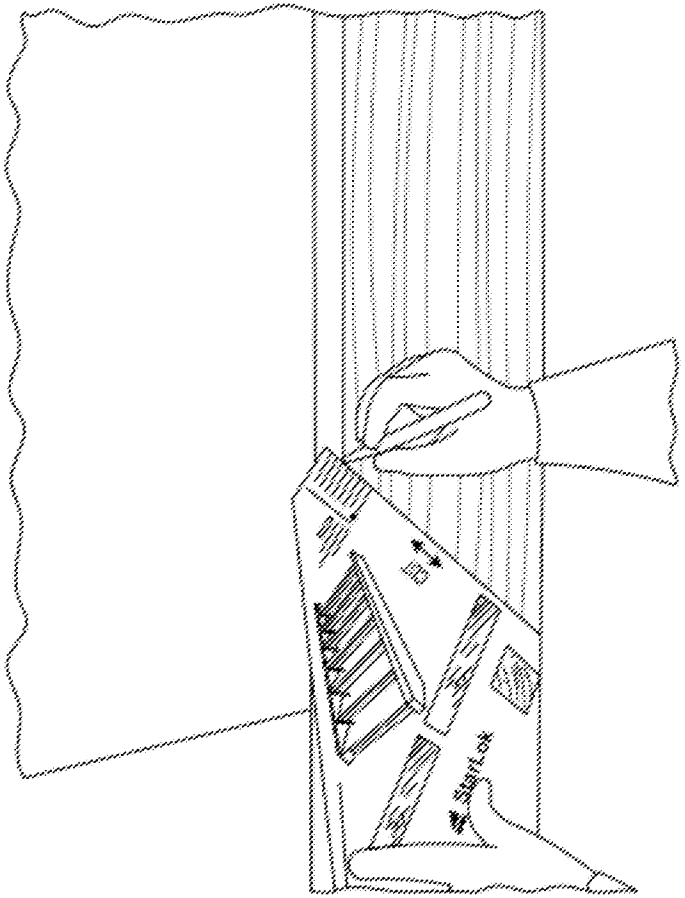
Figure 13:
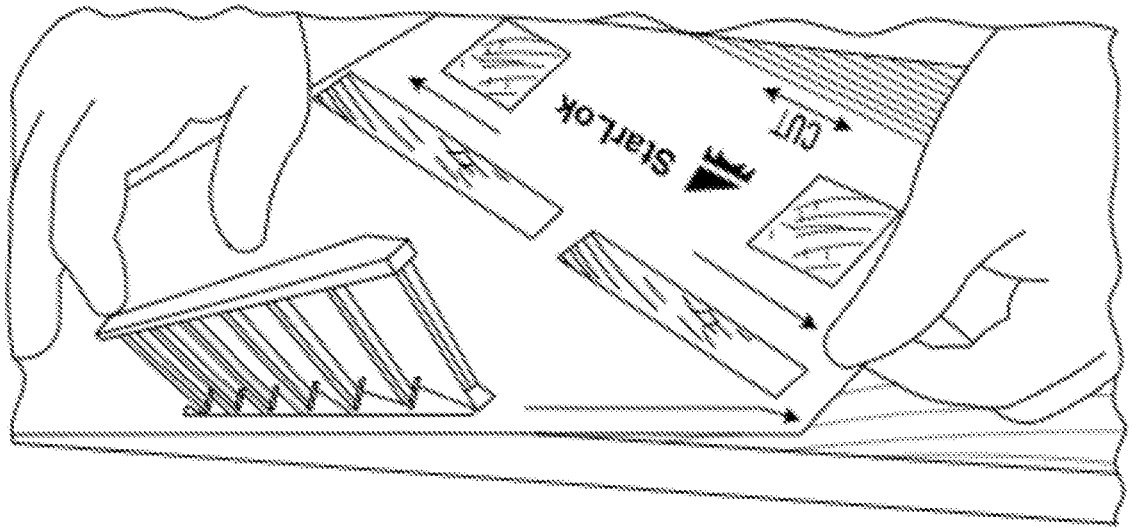
Figure 14:
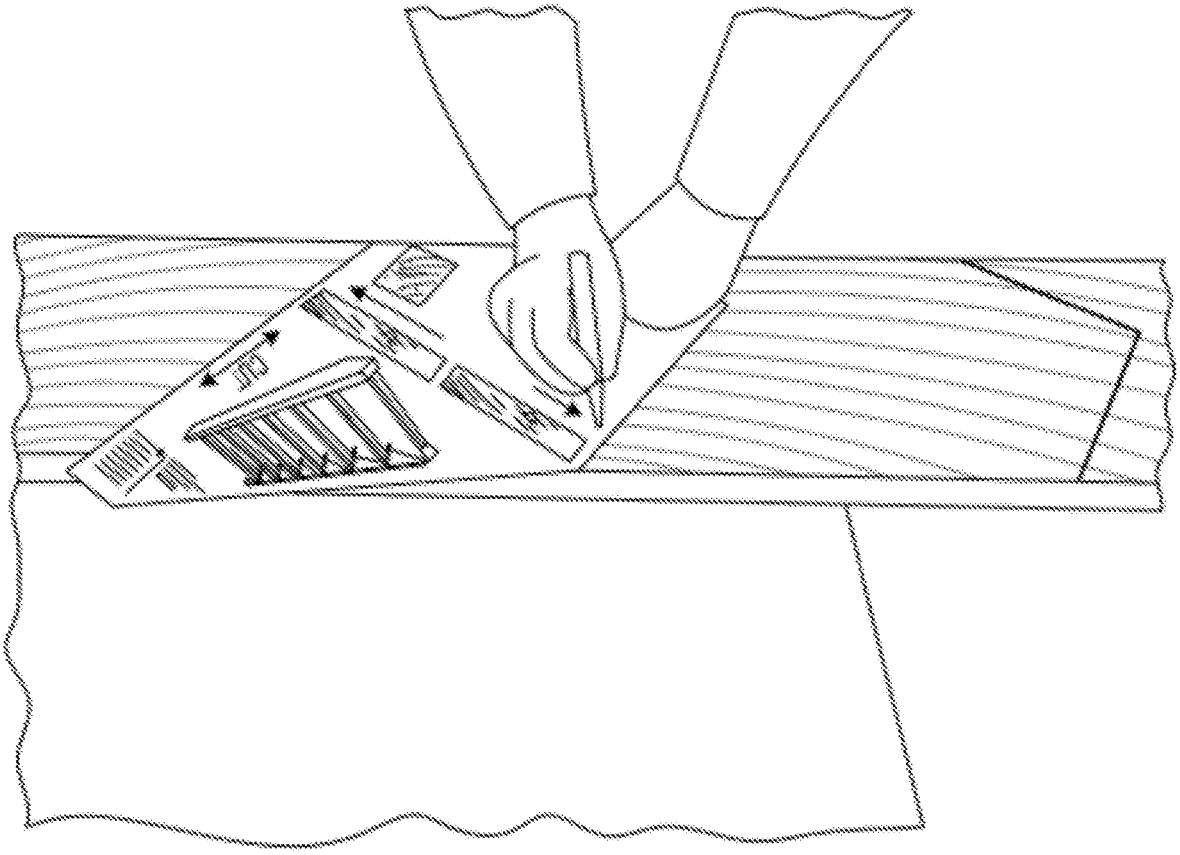
Figure 15:
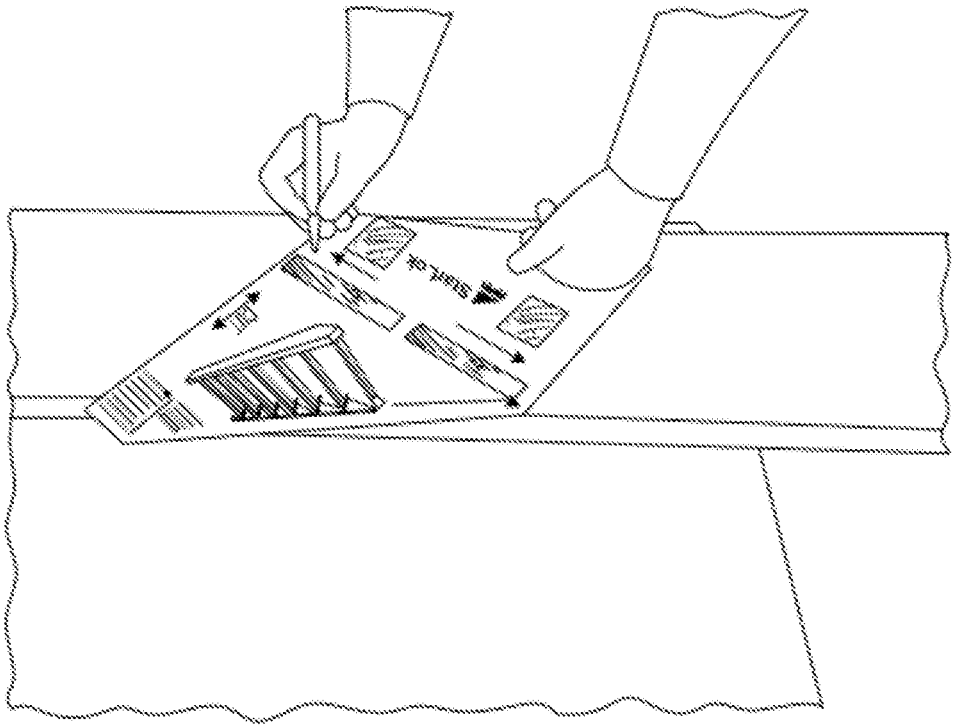
Figure 16:
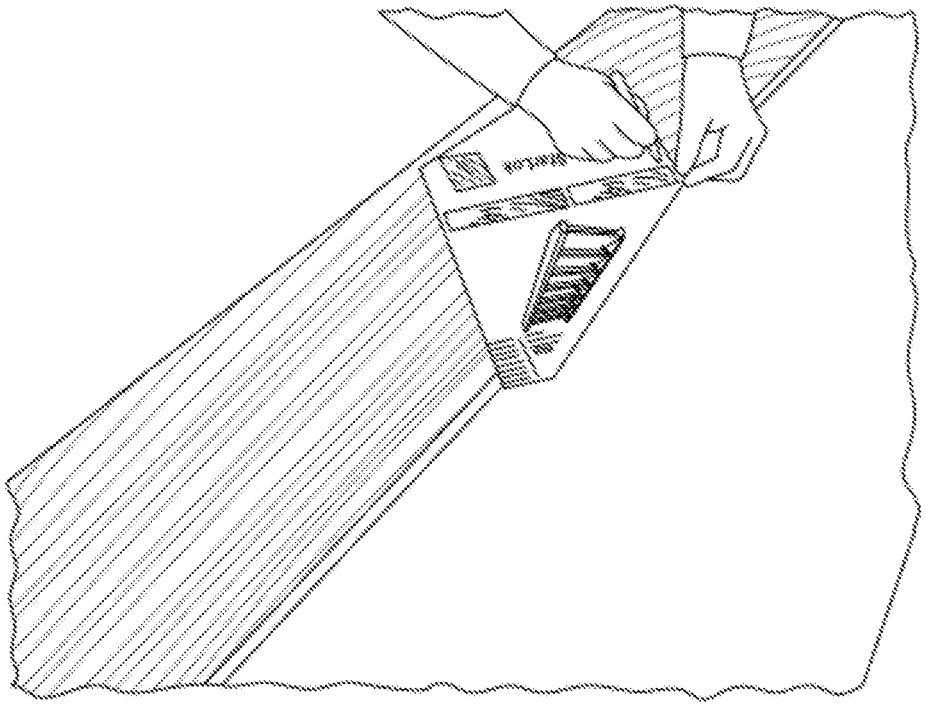
FIGS. 16-19 illustrate a method of using the template of FIG. 1 to mark cutting lines for the top of the stringers.
Figure 17:
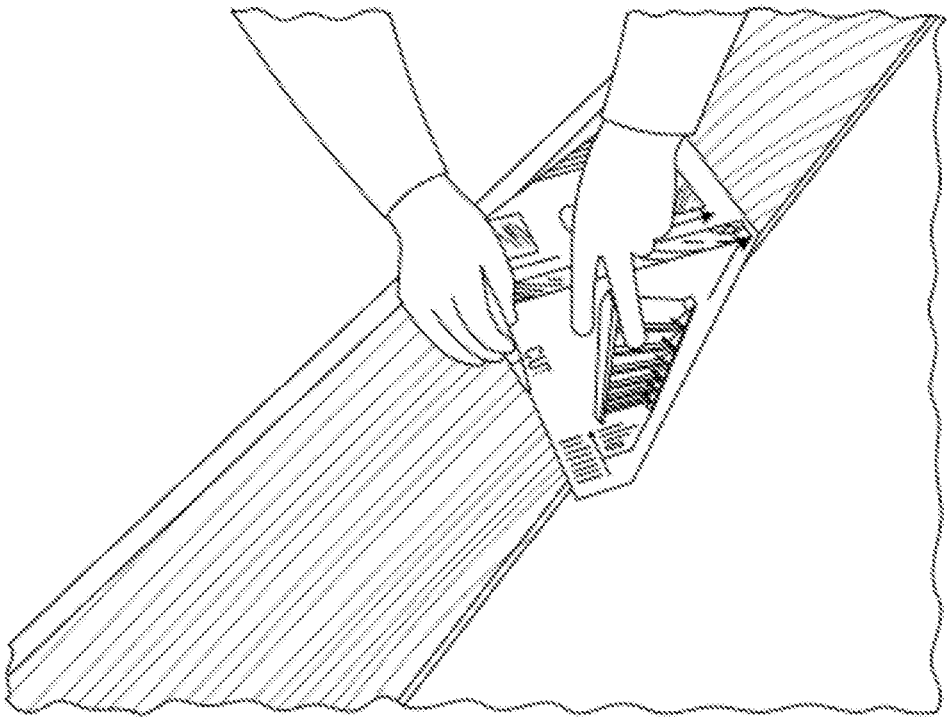
Figure 18:
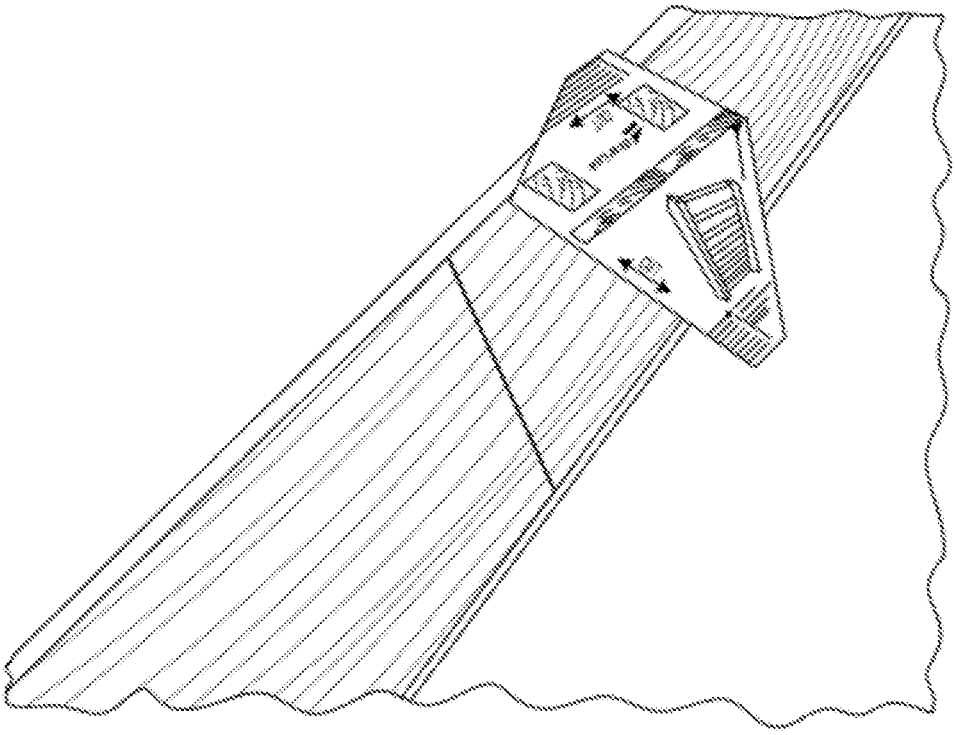
Figure 19:
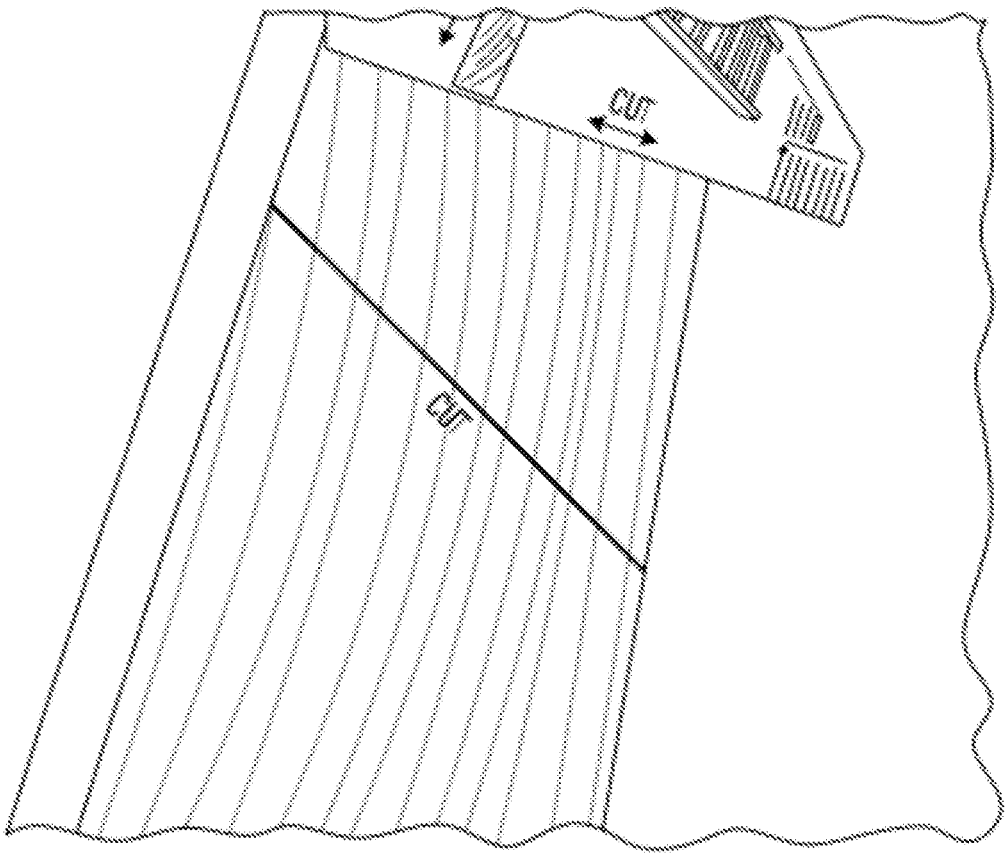

Next, the first corner 110 point is moved to the small mark previously made on the edge of the stringer 102 in the previous step (FIGS. 12, 13). Again, the edge of the stringer 102 is again aligned to the index line on the scale 114 that corresponds to the rise-per-tread of the stair and the next two set points are marked (FIGS. 14, 15). The template 100 is moved to the "2. ALIGN" mark and the procedure is repeated for each tread location in the series.

When the top tread location is reached, a line is drawn down the side of the template adjacent to the "2. ALIGN" corner to indicate a cutline where the stringer 102 will meet the perimeter of the landing (FIGS. 16-19).

Using the opposite side of the template, the inside of the other stringer 104 is marked following the same procedure.

After both stringers 102, 104 have been marked, they are ready to be cut at the top and bottom. The prebuilt treads or tread modules 106 are secured in place by matching the holes in the brackets of the modules 106 with the set point marks on the first stringer 102. After screwing the treads 106 to the first stringer 102, the unit is turned over on top of the other stringer 104 and the procedure is repeated.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A stair layout template, comprising:

a first side comprising:

a first scale along at least a portion of a first edge for marking cutting lines along tops of right stringers of a set of stairs to be constructed, the first scale comprising a plurality of index lines perpendicular to the first edge and corresponding to a plurality of possible rises-per-tread of the set of stairs;

a second scale along at least a portion of a second edge, the second edge being parallel to the first edge, the second scale being a copy of the first scale, for marking the cutting lines along bottoms of the right stringers, the second scale having the plurality of index lines perpendicular to the second edge;

first and second indicators for marking a first set of tread screw set points along the right stringer, the first indicator being adjacent the first edge and the second indicator being adjacent a second edge, parallel to the first edge; and a second side, being a mirror of the first side, comprising:

a the third scale along at least a portion of the first edge, the third scale being a copy of the first scale, for marking cutting lines along the tops of left stringers of the set of stairs, the third scale having the plurality of index lines perpendicular to the first edge;

a fourth scale along at least a portion of the second edge, the fourth scale being a copy of the first scale, for marking the cutting lines along bottoms of the left stringers, the second scale having the plurality of index lines perpendicular to the second edge; and third and fourth indicators for marking a second set of tread screw set points along the left stringer, the third indicator being adjacent the first edge and the fourth indicator being adjacent a second edge;

the first and second sets of tread screw set points indicative of locations on the right and left stringers where holes screws will attach tread modules between the right and left stringers.

2. The stair layout template of claim 1, wherein:

the first and second indicators comprise a first pair of punch marks adjacent opposites edges of the first side; and the third and fourth indicators comprise a second pair of punch marks adjacent opposites edges of the second side;

wherein the first and second sets of punch marks are aligned with each other through the stair layout template.

3. The stair layout template of claim 1, further comprising:

a first pivot point indicated on the first side at a corner of the second edge; and a second pivot point indicated on the second side at the corner of the second edge.

4. The stair layout template of claim 1, wherein the template is formed from a single piece of material on which the scales and indicators are printed.

5. The stair layout template of claim 4, wherein the single piece of material is a non-durable material.

6. The stair layout template of claim 4, wherein the single piece of material is a durable material.

7. A method for constructing a set of stairs, comprising:

placing a first side of a template onto an inside surface of a right stringer of a set of stairs to be constructed;

based on a first set of indicators on the first side, marking a first set of cutting lines along a top and a bottom of the right stringer;

based on a second set of indicators on the first side, marking a first set of tread screw set points along the right stringer;

placing a second side of the template onto an inside surface of a left stringer of the set of stairs, the second side being the mirror of the first side;

based on a first set of indicators on the second side, marking a second set of cutting lines along a top and a bottom of the left stringer;

based on a second set of indicators on the second side, marking a second set of tread screw set points along the left stringer;

cutting the top and bottom of the right stringer along the first set of cutting lines;

cutting the top and bottom of the left stringer along the second set of cutting lines; and securing a plurality of tread modules between the right and left stringers at the marked first and second sets of tread screw set points.

8. The method of claim 7, wherein:

marking the first set of cutting lines comprises:

selecting a first index on a first scale on the first side, the first index representing a selected one of a plurality of rises-per-tread of the set of stairs;

marking a cutting line along the top of the right stringer at the selected first index on the first scale;

selecting a second index on a second scale on the first side, the second index representing the selected rise-per-tread of the set of stairs; and marking a cutting line along the bottom of the right stringer at the second index line on the second scale; and marking the second set of cutting lines comprises:

selecting a third index on a third scale on the second side, the third index representing the selected rise-per-tread of the set of stairs;

marking a cutting line along the top of the left stringer at the selected third index on the second scale;

selecting a fourth index on a third scale on the second side, the fourth index representing the selected rise-per-tread of the set of stairs; and marking a cutting line along the bottom of the left stringer at the fourth index line on the fourth scale.

* * * * *